US005133094A

United States Patent [19]

Clarke, Jr.

[11] Patent Number: 5,133,094

[45] Date of Patent: Jul. 28, 1992

[54] TUB/SHOWER VALVE LOCATING FIXTURE

[76] Inventor: Thomas H. Clarke, Jr., 18887 Devon Ave., Saratoga, Calif. 95070

[21] Appl. No.: 730,057

[22] Filed: Jul. 15, 1991

[51] Int. Cl.[5] ..... E03C 1/04

[52] U.S. Cl. ..... 248/68.1; 248/74.4; 4/696

[58] Field of Search ..... 4/191, 192; 248/57, 248/68.1, 74.4; 137/360

[56] References Cited

U.S. PATENT DOCUMENTS

| | | | |
|---|---|---|---|
| 1,850,616 | 3/1932 | Barnett | 248/57 X |
| 2,295,888 | 9/1942 | Bucknell et al. | 4/192 |
| 2,537,437 | 1/1951 | Aaby | 248/57 |
| 2,661,483 | 12/1953 | Tortorice | 4/191 |
| 3,216,025 | 11/1965 | Roll | 4/192 |
| 3,582,029 | 6/1967 | Moesta | 248/68.1 |
| 3,606,217 | 9/1971 | Leiferman | 248/68.1 |
| 3,944,175 | 3/1976 | Kearney | 248/68.1 X |
| 4,262,869 | 4/1981 | Menshen | 248/74.4 |
| 4,654,900 | 4/1987 | McGhee | 4/191 |
| 5,060,892 | 10/1991 | Dougherty | 248/57 |

*Primary Examiner*—Henry J. Recla
*Assistant Examiner*—Robert M. Fetsuga
*Attorney, Agent, or Firm*—Paul F. Schenck

[57] ABSTRACT

A mounting fixture for positioning a tub and/or shower valve assembly inside a stud wall. The mounting fixture includes a pair of L-shaped brackets having rows of holes in the long flanges of the brackets for securing the brackets to the face of the studs, and slots formed in the short flanges of the brackets. The mounting fixture further includes a pipe clamp in the form of a pair of clamp shells for clamping to a selected pipe of the valve assembly. Each of the clamp shells have a pair of guides formed on opposing surfaces that operate in the slots formed in the short flanges of the brackets.

7 Claims, 5 Drawing Sheets

TUB/SHOWER VALVE LOCATING FIXTURE

FIELD OF THE INVENTION

The present invention relates to positioning and mounting of bathtub and shower valves within stud walls. The tub/shower valve locating fixture is designed as a pipe clamp that can be readily assembled in the field to position a bathtub and shower valve arrangement of which the clamped pipe is a part within the space between studs of a stud wall.

PRIOR ART

The present invention differs from other fixtures in that it allows to assemble locating fixture and valve assembly prior to installation, that it provides means for a proper and precise positioning of the valve assembly in the stud wall. Other locating devices and assemblies do not provide the preassembly capability but are installed first and pipes are attached afterwards or vice versa. The preassembly feature simplifies the installation process.

The Universal Plumbing Pipe Locator and Support disclosed in U.S. Pat. No. 4,550,451 is a typical example for a support bracket which provides a plurality of openings for supporting a pipe, it can be attached to two studs for proper positioning of the pipes protruding through the wall. It is a pipe support fixture.

The Stubout Bar of U.S. Pat. No. 4,909,461 performs basically the same function, but provides a different pattern of notches to hold pipes.

The Bracket for Valve Fixtures is another example for supporting pipes protruding a wall. It has no positioning function for the entire valve assembly.

The Pipe Supports and Hanger of U.S. Pat. No. 3,944,175 is another arrangement of straps and clamps used to affix pipes after they have been installed.

The Plumbing Assembly disclosed in U.S. Pat. No. 2,773,708 is still another device which is installed after the pipes are brought in and keeps the installed pipe in place by using a special pipe elbow fitting which can be affixed to a positioning cross bar.

BACKGROUND OF THE INVENTION

When installing a hot and cold water fixture for a bath tub or a shower the location of the tub spout and the location of the shower head are predetermined by the location of the bath tub respectively the shower stall. A hot and cold water fixture and the tub spout and/or the shower head are connected by pipes.

A valve fixture can be pre-assembled with fittings for the tub spout and/or the fitting for the shower head using conventional pipes for interconnecting the valve fixture and the fittings before the arrangement is installed. The actual location of the assembly inside the stud wall depends on the thickness of the finished wall of the stud wall in the area of the fixtures. The installation instructions of the valve fixture provide the required space between the outside of the finished wall and the valve fixture body. Subtracting Subtracting the thickness of the finished wall from the required space gives the depths at which the valve body is to be mounted inside the stud wall. The locating fixture of the present invention includes markings which reference the center of a pipe clamped by this locating fixture to the front of the locating fixture of the present invention. Markings on the front of the locating fixture allows to position the clamped pipe at a desired space between the studs adjacent to the clamped pipe. In most cases the clamped pipe is either the pipe providing water to either the shower head or the tub spout and can easily be related to the required space defined in the installation manual. However, the valve assembly can be positioned in a similar fashion using the hot or cold water supply pipes of the valve fixture as mounting reference in the locator fixture of the present invention. The location of the pipes supplying hot and cold water depend on other factors and do not necessarily line-up with the fixture.

DESCRIPTION OF THE INVENTION

The tub/shower valve locating fixture of the present invention consists of two equal L-shaped brackets, a pipe clamp mounted between the short flanges of the L-shaped brackets and an adapter for the pipe clamp to accommodate pipes of different outer diameters. Scales stamped or printed on the brackets allow to preassemble and attach the valve assembly to the locating fixture before both as one assembly are affixed to studs of the stud wall. The scales on the short flanges reference the center of the clamped pipe to the front of the L-brackets. The scales on the long flanges reference the center of the clamping fixture to the studs and show the distance between the clamped pipe and the neighboring studs.

DESCRIPTION OF THE PREFERRED EMBODIMENT

Figure 1:
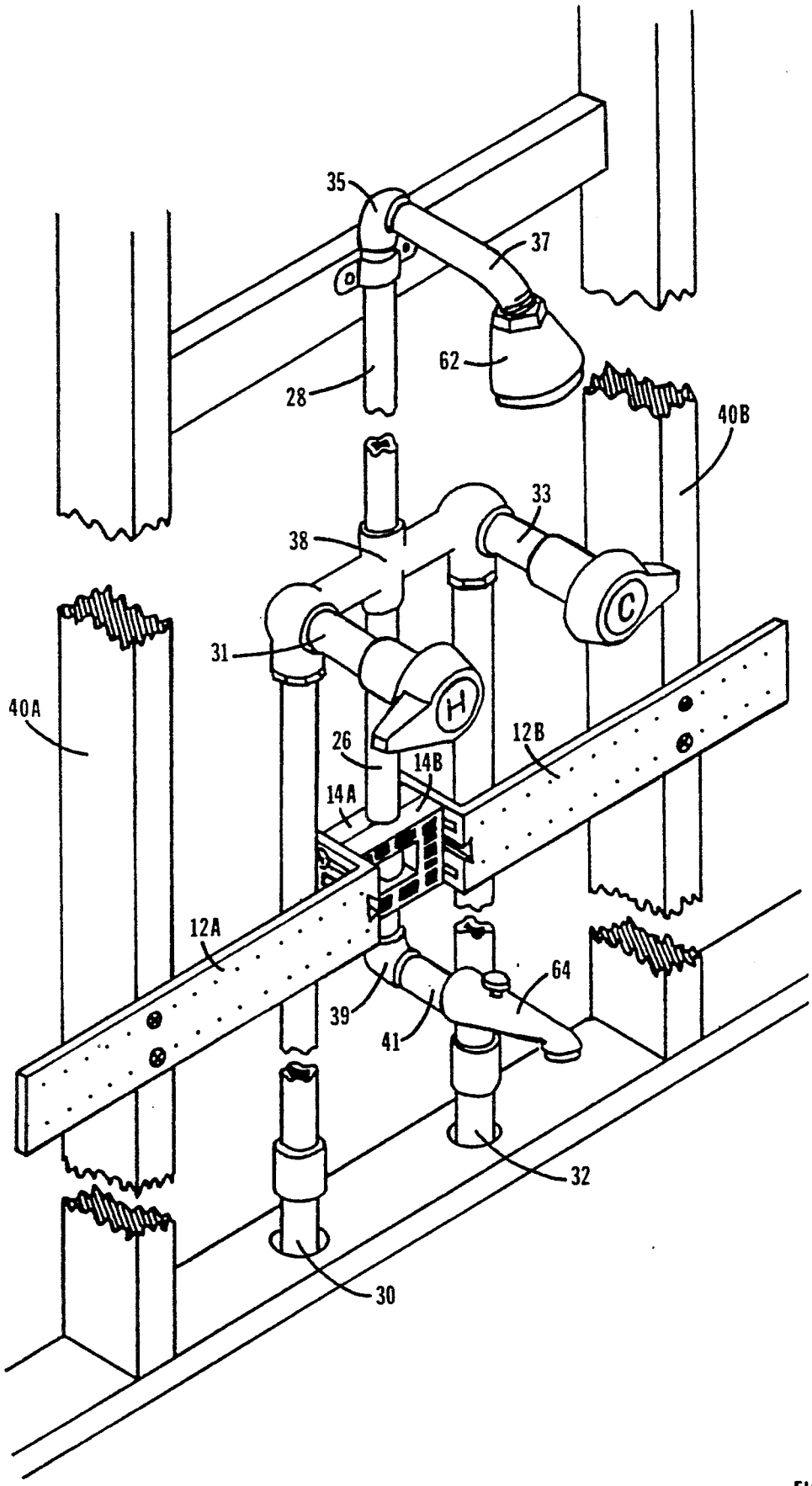
FIG. 1 is a perspective view of a tub/shower valve locating fixture installed for supporting a bathtub spout and shower head fixture in a stud wall.

Although specific terms are used in the following description for the sake of clarity, these terms are intended to refer only to the particular structure of the invention selected for describing the preferred embodiment shown in the drawings, and are not intended to define or limit the scope of the invention.

FIGS. 1 through 5 illustrate the preferred embodiment of a tub/shower valve locating fixture, which includes two L-shaped brackets 12*a* and 12*b*, pipe clamp shells 14*a* and 14*b* as major components, is used for locating and supporting a bathtub and/or shower valve plumbing fixture at a specific location between studs 40*a* and 40*b* of a building's stud wall as illustrated in FIG. 1. Hot and cold water are supplied by hot water pipe 30, respectively cold water pipe 32 and controlled by hot water valve 31, respectively cold water valve 33. Tub/shower valve 38 mixes hot and cold water as supplied by valves 31 and 33 and directs the mixed water to either shower head 62 or bath tub spout 64. Pipe 26, elbow 39, and pipe 41 feed water from valve 38 to spout 64. Pipe 28, elbow 35, and shower arm 37 feed water from valve 38 to shower head 62. Shower arm 37 and pipe 41 protrude through the finished wall (not shown in FIG. 1) which will be attached to studs 40*a* and 40*b* following installation of the plumbing fixture. Clamp shell 14*a* holding pipe 26 acts as a spacer between L-shaped bracket 12*a* and L-shaped bracket 12*b*. Clamp shell 14*b* is secured onto clamp shell 14*a* and holds pipe 26 in place. Instead of clamping pipe 26 the tub/shower valve locating fixture can be mounted above valve 38 and clamped onto pipe 28.

The universal bracket includes two L-shaped brackets 12*a* and 12*b*, and a pipe clamp consisting of spacing clamp shells 14*a* and holding clamp shell 14*b*.

Figure 2A:
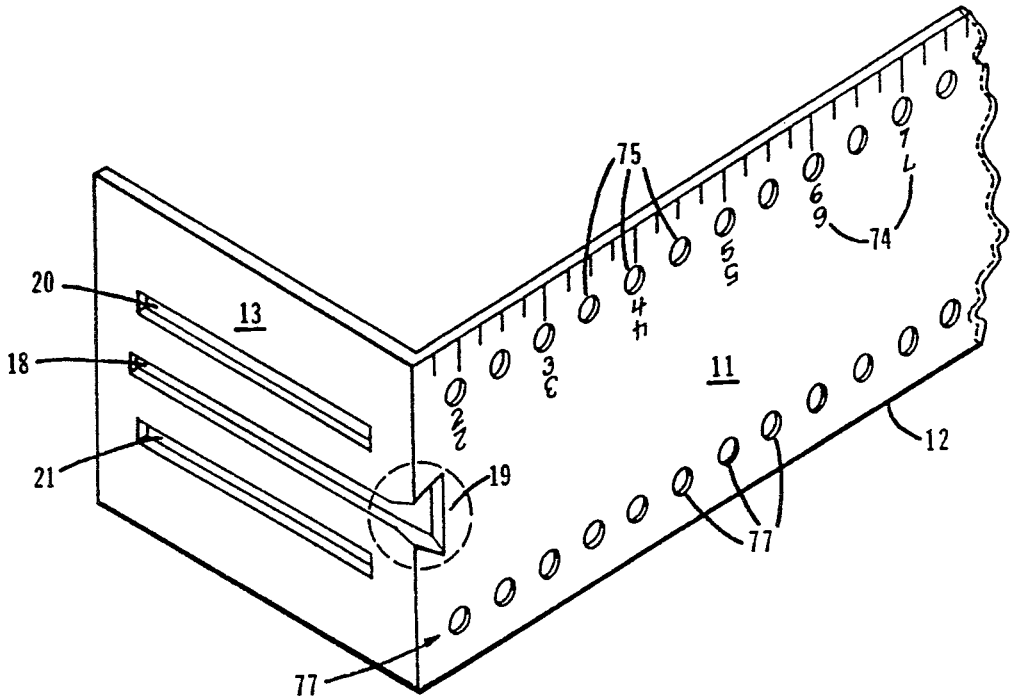
FIGS. 2*a* and 2*b* are perspective views of an L-shaped bracket, a component of the tub/shower valve locating fixture.
Figure 2B:
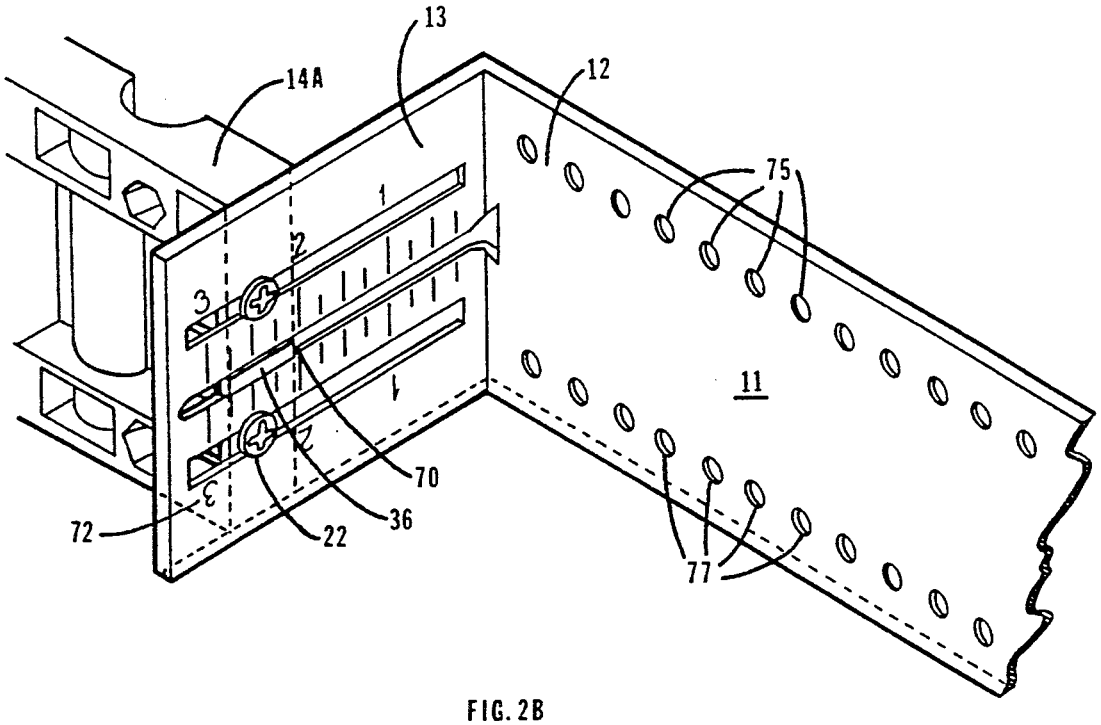

L-shaped brackets 12*a* and 12*b* each consist of a short flange 13 and a long flange 11 positioned at a right angle, see FIGS. 2*a* and 2*b*. Short flange 13 is in length equal to or less than the depth of a building stud wall, and has three parallel slots. Middle slot 18 is centered on the part and extends into longer flange 11 of the bracket. The width of slot 18 is determined by the width of guide ribs 36 of clamp shells 14*a* and 14*b* (see FIG. 3). Where middle slot 18 reaches into longer flange 11 of the L-shaped bracket, the slot width is gradually widened to slot entry 19 to ease insertion of guide ribs 36*a* and 36*b* of a clamp shells 14*a* and 14*b* into slot 18. The length of slot 18 on flange 13 of a bracket 12 allows to affix clamp shells 14*a* and 14*b* at any desired depth inside a stud wall. The two outer slots 20 and 21 on flange 13 of the bracket shown in FIG. 2*a* are equally spaced from slot 18, and match up with mounting holes of clamps 14*a* and 14*b* . The length of these two slots are less than the length of short flange 13 to maintain the strength and integrity of the L-shaped bracket.

Two rows of suitably spaced holes 75 and 77 extend over the length of flange 11 of the L-shaped bracket, to fasten the bracket to bulding stud member with nails, screws or other type of fasteners. On the outside of long flange 11 facing away from the stud wall and on the inside of short flange 13 facing away from clamp 12, see FIG. 2*b*, there are reference lines with suitably spaced markers and numerals. For ease of explanation these arrangements of reference lines will be called scales. Scale 74 on long flange 11 references the distance from the center of a clamp 14 attached to shorter flange 13. Scale 72 on short flange 13 references the distance from the face of long flange 11 of bracket 12.

Figure 3:
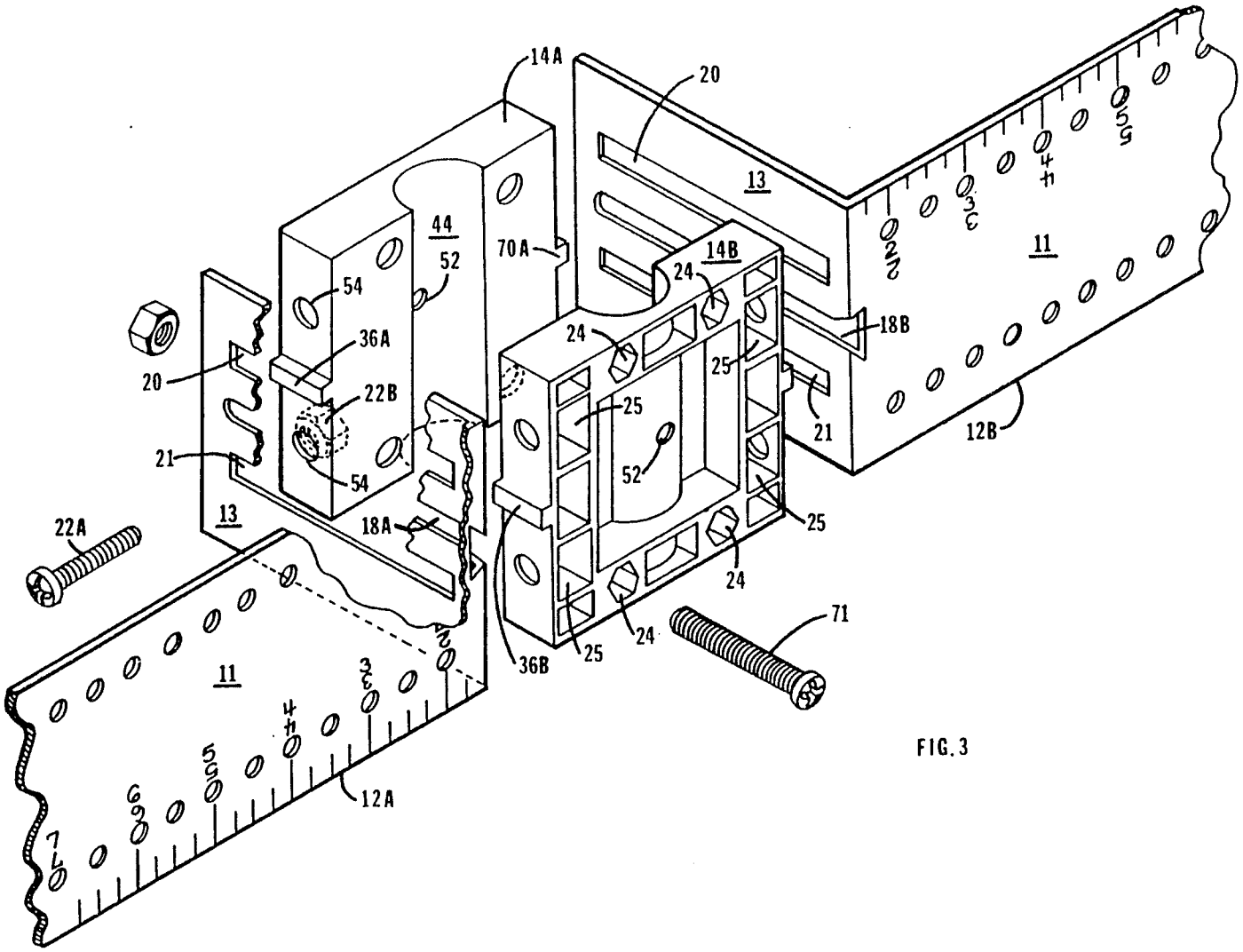
FIG. 3 is an exploded, perspective view of the invention.
Figure 4:
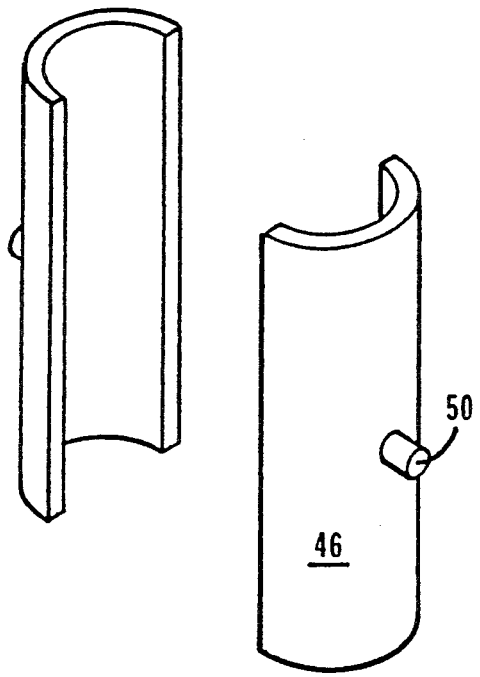
FIG. 4 is a perspective view of a pipe adapter for the tub/shower valve locating fixture.

The pipe clamp is made up of a pair of rectangular shells 14*a* and 14*b*, each having a cooperating vertical semi-circular recessed area 44 on the front side (see FIG. 3). Shells 14*a* and 14*b* are assembled with the recessed areas 44 parallel and facing each other for clamping onto a water pipe of the tub or shower valve arrangement. Recessed areas 44 have each a small round opening 52 in the very center for receiving registration pin 50 of a accessory spacer consisting of two identical pipe clamp adapters 46 (see FIG. 4).

Clamp shells 14*a* and 14*b* may be identical, however, clamp shell 14*a* is used as a spacer between L-shaped brackets 12*a* and 12*b*, shell 14*b* in combination with 14*a* is used to clamp a pipe. The backsides of clamp shells 14*a* and 14*b* include each four strategically placed cavities 24 for insertion of machine screws and nuts which attach clamp shell 14*b* onto clamp shell 14*a*. Four cavities 25 (reference for clamp shell 14*b*) of clamp shell 14*a* receive nuts for mounting clamp shell 14*a* between flanges 13 of brackets 12*a* and 12*b* using screws 22 (only one screw is shown for clarity). Shell 14*b* does not have to be fastened to short flanges 13 of L-brackets 12*a* and 12*b*. Ribs between cavities 24 and 25 are used to strengthen the clamp shell. On the two narrower sides of shells 14*a* and 14*b* facing short flanges 13 of brackets 12*a* and 12*b* there are rectangular guiding ribs 36*a* and 36*b* spanning the width of the assembled clamp. These ribs allow the clamp to slide horizontally from front to back in slots 18 of flanges 13 of L-shaped brackets 12*a* and 12*b* for proper placement of clamp shells 14*a* and 14*b* within the interior of a building wall. Located above and below this guide are openings 54 that will allow machine screws to pass through to nuts located in cavities 25 of clamp shell 12*a*.

During assembly clamp 14*a* can slide in between brackets 12*a* and 12*b* guided by guides 36*a* in guide slot 18*a* of bracket 12*a* and guides 70*a* in guild slot 18*b* of bracket 12*b* as long as screws 22*a* through 22*d* are not tightening clamp shell 14*a* through slots 20 and 21 to brackets 12*a* respectively 12*b*, see FIG. 3 (only screw 22*a* is shown in FIG. 3). Guiding slots 18 are widened at the bend of brackets 12*a* and 12*b* for easy insertion of guides 36*a* and 36*b* into guiding slots 18. Clamp 14*a* and brackets 12*a* and 12*b* can be preassembled and aligned using the forward edge 70 of clamp 14*a* as reference for a desired setting on scale 72 as shown in FIG. 2*b*. The location at which clamp shell 14*a* is affixed between brackets 12*a* and 12*b* depends entirely on the thickness of the wall through which the controls of valves 31 and 33 protrude. In general the space between the front surface of the finished wall and the center of the valve fixture is given by the manufacturer of the fixture. Subtracting the wall thickness from this manufacturer defined space value gives the distance from the outside of the long flanges 11 to forward edge 70 of clamp 14*a*.

Brackets 12*a* and 12*b* have scales 74*a*, respectively 74*b* which are used for mounting the assembly consisting of brackets 12*a*, 12*b*, and clamp 14*a* on studs 40*a* and 40*b* at the preferred height and preferred lateral position between studs 40*a* and 40*b*.The preferred lateral position is determined by the center of either pipe 26 or pipe 28. After mounting the bracket assembly on studs 40*a* and 40*b*, the valve assembly is put in place by clamping pipe 26 between spacer clamp shell 14*a* and front clamp shell 14*b*. Clamp shell 14*b* is attached to clamp shell 14*a* using screws 71 (only one screw is shown in FIG. 3). Another sequence of installation is to preassemble the locating fixture and the valve assembly and then mounting the combined assembly on the stud wall.

The installation is completed by connecting cold water valve 33 to cold water supply pipe 32 and warm water valve 31 to warm water supply pipe 30.

Figure 5:
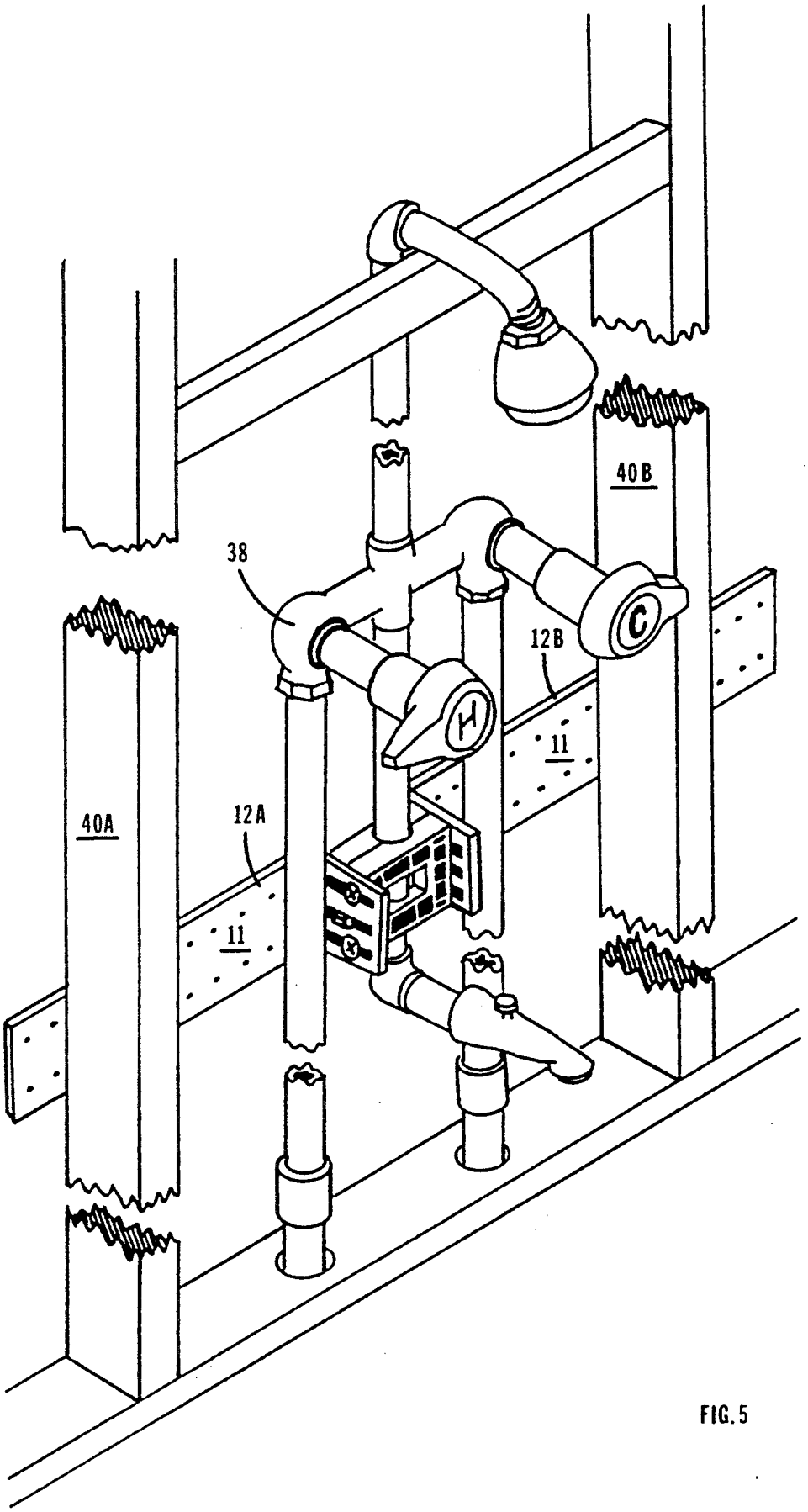
FIG. 5 is a perspective view showing a tub/shower valve locating fixture in a reverse mounting application.

Pipe clamping surfaces 44*a* and 44*b* of the clamp shells 14*a* and 14*b* are designed for clamping ½" Iron Pipe Size brass or iron rigid pipe. When a tub/shower valve 38 with ½" nominal copper sweat outlets is used, which have a smaller outer diameter than the ½" brass or iron pipes, adaptor 46 of the invention is used in combination with clamp shells 14 to adapt the universal valve bracket to the smaller pipe diameter. Adaptor 46 is placed with peg 50 inserted in receiving hole 52 in iron pipe clamping surfaces 44*a* and 44*b* of shells 14*a*, respectively 14*b*. The universal bracket of the present invention can be used for mounting a valve assembly on the front or on the rear side of a shower or bathtub stud wall. FIG. 5 is an illustration of an application in which the universal bracket of the present invention is installed from the rear side of the shower or tub stall. The universal tub/shower valve bracket is mounted from the backside of the studs 40*a* and 40*b*. The location of tub/-shower valve 38 is not changed. The only change in installation is, that all measurements for mounting the valve assembly and relating to the scales on the L-shaped brackets have to be made relative to the front-side of studs 40*a* and 40*b* instead of the outside of long flanges 11 of L-shaped brackets 12*a* and 12*b*.

While the above description relates to a combined tub/shower valve 38, it is understood, that the same could be assembled from individual valves, pipes and pipe connectors, that is may serve only a shower head or a tub spout, and that it might include a separate control to direct water selectively to either the shower head or the tub spout instead of a diverter spout which is shown in FIG. 2.

What I claim is:

1. A locating fixture for mounting a tub/shower valve assembly at a predetermined depth inside a wall and a predetermined distance between studs of a stud wall, said tub/shower valve assembly having at least one water pipe, comprising a first and a second L-shaped bracket, each having a short flange and a long flange at a substantially right angle to each other, and having an outside surface and an inside surface, a first clamp shell mounted between said outside surface of said short flange of said first L-shaped bracket and said outside surface of said short flange of said second L-shaped bracket at a predetermined distance from the outside surfaces of said long flanges of said first and said second L-shaped brackets, said long flanges thereby establishing a reference plane for mounting said first clamp shell at said predetermined depth inside said stud wall; a second clamp shell mounted between said outside surfaces of said short flanges of said first and said second L-shaped brackets;

means for attaching said second clamp shell to said first clamp shell for clamping said water pipe placed between said first clamp shell and said second clamp shell, said L-shaped brackets including at least one row of holes arranged along the extend of said long flanges for attaching said assembly between two of said studs thereby positioning said clamped pipe at said predetermined distance between said studs;

a first slot formed in each of said short flanges, said first and second clamp shells including opposing surfaces having sliding guides formed thereon, said opposing surfaces facing said short flanges of said first and second brackets when said clamp shells are mounted between said short flanges, said sliding guides operate in said first slots of said brackets, thereby positioning said pipe at said predetermined distance from said reference plane, and means to affix at least one of said clamp shells to said short flanges.

2. A locating fixture for mounting a tub/shower valve assembly at a predetermined depth inside a wall and a predetermined distance between studs of a stud wall as claimed in claim 1, wherein said short flanges of said first and said second L-shaped brackets including on said inside surfaces reference markers for positioning said first clamp shell at a desired distance from said reference plane.

3. A locating fixture for mounting a tub/shower valve assembly at a predetermined depth inside a wall and a predetermined distance between studs of a stud wall as claimed in claim 1, wherein said long flanges of said first and said second L-shaped brackets including reference markers on said outside surfaces for positioning said first clamp shell at a desired distance between said studs.

4. A locating fixture for mounting a tub/shower valve assembly at a predetermined depth inside a wall and a predetermined distance between studs of a stud wall, said tub/shower valve assembly having at least one water pipe, comprising a first clamp shell;

a second clamp shell;

a first and a second L-shaped bracket, each having a short flange and a long flange at a substantially right angle to each other, and having an outside surface and an inside surface, said first clamp shell mounted between said outside surface of said short flange of said first L-shaped bracket and said outside surface of said short flange of said second L-shaped bracket at a predetermined distance from the outside surfaces of said long flanges of said first and said second L-shaped brackets, said long flanges thereby establishing a reference plane for mounting said first clamp shell at said predetermined depth inside said stud wall; said second clamp shell mounted between said outside surfaces of said short flanges of said first and said second L-shaped brackets;

means for attaching said second clamp shell to said first clamp shell for lamping said water pipe laced between said first clamp shell and said second clamp shell, said L-shaped brackets including at least one row of holes arranged along the extend of said long flanges for attaching said assembly between two of said studs thereby positioning said clamped pipe at said predetermined distance between said studs;

said short flanges of said first and second brackets including reference markers on said inside surfaces for positioning said first clamp shell at a desired distance from said reference plane;

a first slot formed in each of said short flanges, said first and second clamp shells including opposing surfaces having sliding guides formed thereon, said opposing surfaces facing said short flanges of said first and second brackets when said clamp shells are mounted between said short flanges, said sliding guides operate in said first slots of said brackets, thereby positioning said pipe at said predetermined distance from said reference plane, and means to affix at least one of said clamp shells to said short flanges.

5. A locating fixture for mounting a tub/shower valve assembly at a predetermined depth inside a wall and a predetermined distance between studs of a stud wall as claimed in claim 4, wherein said means to affix said at least one clamp shell to said short flanges of said brackets include at least one second slot in each of said short flanges adjacent and parallel to said first slot, and means engagable with said second slot for securing said clamp shell to said brackets.

6. A locating fixture for mounting a tub/shower valve assembly at a predetermined depth inside a wall and a predetermined distance between studs of a stud wall, said tub/shower valve assembly having at least one water pipe, as claimed in claim 4, said fixture further including means for adapting said clamp shells to small diameter water pipes including a third and a fourth clamp shell mounted between said first and second clamp shells for encasing said small diameter water pipe, whereby said small diameter water pipe can be clamped like a regular diameter water pipe.

7. A method for mounting a tub/shower valve fixture assembly consisting of valves and spouts interconnected by pipes between studs of a stud wall at a predetermined depth inside said stud wall and at a predetermined distance between studs of said stud wall using a positioning fixture including mounting brackets, a spacer shell, and a clamping shell for positioning the location of a reference pipe of said pipes included in said valve fixture, each of said brackets having a short flange and a long flange at a substantially right angle to each other and an inside surface and an outside surface, each of said brackets further having a first slot formed in each of said short flanges, said spacer and clamping shells including opposing surfaces having sliding guides formed thereon, said opposing surfaces facing said short flanges of said first and second brackets when said spacer and clamping shells are mounted between said short flanges, said sliding guides operate in said first slots of said brackets, comprising the steps of assembling said valve fixture assembly, determining the depth at which said reference pipe is to be positioned inside the space between said studs from the front side of said studs, and assembling said positioning fixture with said spacer shell mounted between said outside surfaces of said short flanges of said two brackets and securing said spacer shell at a distance from said long flanges corresponding to said depth, clamping said reference pipe of said valve fixture between said spacer shell and said clamping shell of said locating fixture, determining the distance at which said reference pipe of said valve fixture is to be located between said studs of said stud wall and affixing said brackets of said locating fixture to said studs of said stud wall.

* * * * *